US010092794B2

(12) United States Patent
Gonima et al.

(10) Patent No.: US 10,092,794 B2
(45) Date of Patent: Oct. 9, 2018

(54) BUOYANCY ASSISTANCE KIT

(71) Applicant: DECATHLON, Villeneuve d'Ascq (FR)

(72) Inventors: Nathalie Gonima, Hendaye (FR); Catherine Lucas-Bouillon, Ascain (FR); Antoine Harpages, Ghuetary (FR)

(73) Assignee: DECATHLON, Villeneuve d'Ascq (FR)

( * ) Notice: Subject to any disclaimer, the term of this patent is extended or adjusted under 35 U.S.C. 154(b) by 0 days.

(21) Appl. No.: 15/117,690

(22) PCT Filed: Feb. 11, 2015

(86) PCT No.: PCT/FR2015/050343
§ 371 (c)(1),
(2) Date: Aug. 9, 2016

(87) PCT Pub. No.: WO2015/121590
PCT Pub. Date: Aug. 20, 2015

(65) Prior Publication Data

US 2016/0354639 A1 Dec. 8, 2016

(30) Foreign Application Priority Data

Feb. 12, 2014 (FR) ..... 14 00394

(51) Int. Cl.
*B63C 9/04* (2006.01)
*A63B 31/12* (2006.01)
(Continued)

(52) U.S. Cl.
CPC ..... *A63B 31/12* (2013.01); *A63B 69/14* (2013.01); *B63C 9/135* (2013.01); *B63C 9/155* (2013.01);
(Continued)

(58) Field of Classification Search
CPC ..... A63B 31/12; A63B 69/14; B63C 9/155; B63C 9/135
See application file for complete search history.

(56) References Cited

U.S. PATENT DOCUMENTS 1,478,239 A 12/1923 Marengo et al.
1,514,435 A 11/1924 Chatham
(Continued)

FOREIGN PATENT DOCUMENTS

DE 29923028 U1 2/2000
DE 102004013848 A1 9/2005

OTHER PUBLICATIONS

International Search Report for International Application No. PCT/FR2015/050343, dated May 13, 2015.

*Primary Examiner* — Stephen P Avila
(74) *Attorney, Agent, or Firm* — Marshall, Gerstein & Borun LLP

(57) ABSTRACT

A buoyancy assistance kit including a belt for surrounding part of the trunk of a user and two armbands each surrounding part of an arm of said user respectively, the belt and the armbands each including at least one element arranged so as to ensure a buoyancy assistance function, each armband being connected to said belt by an element, each element having an elasticity which allows the relative position of the armband to be adapted in relation to the belt when being worn.

9 Claims, 2 Drawing Sheets

(51) Int. Cl.
*A63B 69/14* (2006.01)
*B63C 9/15* (2006.01)
*B63C 9/135* (2006.01)

(52) U.S. Cl.
CPC ..... *A63B 2208/03* (2013.01); *A63B 2208/12* (2013.01); *A63B 2210/50* (2013.01); *A63B 2225/096* (2013.01); *A63B 2225/605* (2013.01); *A63B 2225/62* (2013.01); *A63B 2244/20* (2013.01)

(56) References Cited

U.S. PATENT DOCUMENTS

| | | | | |
|---|---|---|---|---|
| 4,692,125 | A * | 9/1987 | Wessman | B63C 9/135 441/108 |
| 7,104,858 | B1 * | 9/2006 | Yonover | B63C 9/20 441/106 |
| 2008/0160849 | A1 | 7/2008 | Steger | |
| 2011/0165805 | A1 * | 7/2011 | Berry | A63B 31/00 441/122 |

* cited by examiner

BUOYANCY ASSISTANCE KIT

CROSS-REFERENCE TO RELATE APPLICATION

The present application is the U.S. national phase of International Patent Application No. PCT/FR2015/050343, filed Feb. 11, 2015, which application claims priority to French Application No. FR 1400394, filed Feb. 12, 2014. The priority application, FR 1400394, is hereby incorporated by reference.

TECHNICAL FIELD

The invention relates to a buoyancy assistance kit intended for discovering the aquatic environment and/or learning to swim.

PRIOR ART

In order to avoid risks of drowning, in particular with a child, it is usual to use a buoyancy assistance kit enabling the user to move in the water in safety and without constraining his freedom of movement. Buoyancy assistance kits come in several forms arranged so as to be worn on a part of the body and which are each suited to an age and/or to a stage of learning to swim.

There exist for example bathing costumes that integrate a buoyancy material for example made from foam or an inflatable buoy, said costumes being in particular worn during the stage of aquatic awakening, to facilitate the child's becoming accustomed to the water.

In a variant or during first swimming lessons, pairs of inflatable or foam armbands can be fitted around the arms of the child in order to assist holding him with his head out of the water and/or assisting his vertical equilibrium.

To increase safety and stability during swimming, the use of these armbands may be combined with the use of a buoyancy bib or belt worn respectively around chest and the waist while being equipped with an inflatable chamber or a plurality of foam floats connected by an attachment harness.

A buoyancy assistance kit combining a pair of armbands and a foam bib is also known from the document US 2008/0160849, said armbands being stitched on each side of said bib. However, such a set is unchangeable, whether in relation to the growth of the child, the armbands being fixed to the bib without facilities for adjustment, or in relation to changes in his level of swimming, said set remaining only suited to an awakening stage and/or a first learning stage.

In order to have a more versatile set, the document U.S. Pat No. 4,692,125 makes provision for connecting armbands to a belt by means of straps surrounding respectively each armband and said belt, said straps being attached reversibly to a ring disposed between an armband and the belt for combined or independent wearing thereof.

In order to adjust the set to the size of the wearer, the document U.S. Pat No. 4,692,125 makes provision for being able to modify the length of the straps by means of adjustment loops.

However this set does not give complete satisfaction in that fitting the straps around the armbands and the belt and the association thereof with rings proves to be complex and requires lengthy adjustments, in particular relative to the morphology of the wearer.

Furthermore, the length of the straps and therefore the position of the armbands with respect to the belt can be modified by means of the adjustment loops only before or after use of the set, which limits the wearing comfort, in particular by constraining the movements of the arms of the wearer.

The invention aims to improve the prior art by proposing a buoyancy assistance kit that is versatile, being adaptable to a plurality of swimming learning stages and/or to the morphology of a wearer, while ensuring optimum comfort in wearing and freedom of movement.

To this end, the invention proposes a buoyancy assistance kit having a belt intended to surround part of the trunk of a wearer and two armbands intended each to surround a part respectively of an arm of said wearer, said belt and said armbands each comprising at least one element arranged to fulfil a buoyancy-aid function, each armband being connected to the belt by means of an element that has elasticity enabling the relative position of said armband to be adapted with respect to said belt during wearing.

BRIEF DESCRIPTION OF THE DRAWINGS

Other particularities and advantages of the invention will emerge in the following description given with reference to the accompanying figures, in which.

Figure 1:
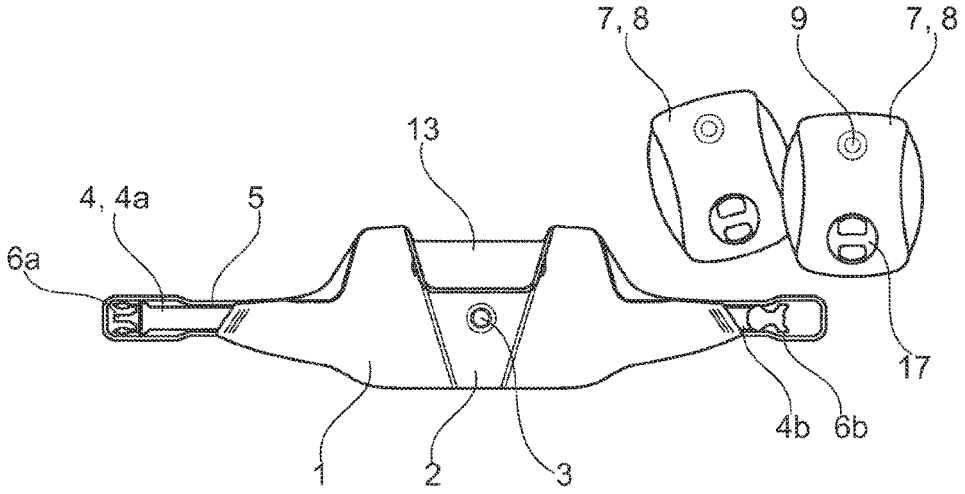
FIG. 1 is a representation of a buoyancy assistance kit according to one embodiment, showing a pair of armbands and a belt separated from each other.

In relation with these figures, a description is given below of a buoyancy assistance kit intended to be worn in particular by a child in the aquatic awakening phase, that is to say during his first swims and/or during various stages of learning to swim.

The set has in particular a belt 1 intended to surround a part of the trunk of the wearer, said belt comprising at least one element arranged to fulfil a buoyancy-aid function.

In particular, the belt 1 may be produced from a flexible polymer material and integrate at least one air chamber 2 that has a deflated storage configuration and an inflated buoyancy configuration. According to the degree of buoyancy required, the dimensions of the belt 1 can be arranged so that it extends over a greater or lesser part of the trunk. In a variant, the belt 1 may be equipped with a bib intended to be disposed against the chest of the wearer or the top of the back, said bib being able to comprise a second air chamber.

According to the embodiment depicted, the belt 1 has a central part and two flanks extending respectively on one side of said central part. The central part of the belt 1 is equipped with a valve 3 for inflating/deflating the air chamber 2, said valve being able to have a non-return function in order to prevent deflation of said chamber.

In another embodiment, the air chamber 2 may be replaced by one or more blocks of material each forming a float for the belt 1, said blocks being produced from a foam material the density of which is arranged to fulfil a buoyancy function, such as a closed-cell foam based on polyethylene.

For wearing it, the belt 1 is equipped with an attachment harness 4 of said belt around the waist of the wearer. The harness 4 may be fixed to said belt or be sliding relative to the buoyancy element of said belt. According to the embodiment depicted, the harness 4 is associated with an internal wall of the belt 1 while extending on either side of the air chamber 2.

Advantageously, the harness 4 slides relative to the air chamber 2, for example by being slidably mounted in a guide sleeve formed in the internal wall of the belt 1, said sliding in particular allowing adjustment of the position of said chamber on the body of the wearer.

The attachment harness 4 may be equipped with a loop 5 for adjusting its length in order to adjust the belt 1 around the waist of the wearer, thus making said belt adaptable to a plurality of morphologies or to the growth of the wearer. Adjustment of the harness 4 also makes it possible to arrange the belt 1 around various wider or narrower parts of the trunk of the wearer, for example around the waist or the abdominal cage.

In relation to the figures, the attachment harness 4 has two free ends 4*a*, 4*b* each equipped with a quick-attachment system. Advantageously, the attachment system is formed by a male element 6*a* with three branches and a female element 6*b* intended to be engaged in each other for snapping together, unsnapping being achieved by a triple pressure on respectively one branch of said male element in order to limit the risk of opening the belt 1 inadvertently.

The buoyancy assistance kit also comprises a pair of armbands 7 intended each to surround a part respectively of an arm of the wearer, said armbands comprising at least one element arranged to fulfil a buoyancy-aid function.

Each of the armbands 7 may comprise an air chamber 8 equipped with an inflation/deflation valve 9. In one embodiment, each armband 7 may comprise a plurality of air chambers that can be inflated separately, so that, in the event of leakage of air from one chamber, said armband keeps its buoyancy functions and a certain lift.

In a variant, each of the armbands 7 may be formed by a block of foam with an ergonomic form and comprising a passage opening for the arm of the wearer, said block of foam having sufficient density to fulfil a buoyancy function.

The armbands 7 may be associated with the belt 1 during wearing for combined use thereof in order to obtain a set suited to a wearer in the aquatic awakening phase. In particular, each armband 7 may be connected to the belt 1 by means of an element 10, said belt then being able to be worn with its buoyancy element positioned against the belly of the wearer. In particular, the element may be in the form of a strap 10, as depicted in the figures, or a link, or a yoke, for example made from fabric, or any other type of structure able to provide the connection between an armband 7 and the belt 1.

In order to assist the freedom of movement of the arms of the wearer and comfort in wearing, each element 10 has elasticity that allows adaptation of the relative position of the armband 7 with respect to the belt 1 during wearing. Furthermore, such elasticity allows wearing of the buoyancy assistance kit by wearers of different sizes as well as adaptation of said set to the growth of the child.

Each element 10 may be produced from an elastic material and/or have extension means such as a bellows allowing its deformation and elastic return in accordance with the movements of the arms and/or of the pelvis of the wearer.

According to the embodiment depicted, each element is in the form of a strap 10 formed by a flat band of material with a quadrilateral geometry. However, the invention is not limited to a particular geometry of each element 10, since said element may for example be in the form of a link or a strap.

In order to obtain a versatile set and thus optimise its use according to the level of swimming and/or experience of the wearer, each element 10 comprises means for the reversible association with an armband 7 and/or with the belt 1 in order to be able to wear said belt or the pair of armbands 7 independently of each other. In particular, the armbands 7 and the belt 1 are respectively arranged so as to be in accordance with buoyancy-aid standards.

Thus, the armbands 7 may be worn without the belt 1 in a stage of familiarisation with swimming movements, when the swimmer is confident or autonomous in the aquatic environment. In a more advanced learning stage, only the belt 1 may be worn, with its buoyancy element positioned on the back of the wearer in order to assist his balance in horizontal swimming.

Apart from the use of the set in various stages of learning swimming, the dissociation of the armbands 7 and belt 1 makes it possible to reduce the bulk of said set when it is stored, said armbands and said belt being able to be stored separately.

According to the embodiment depicted, the buoyancy assistance kit has two straps 10 connecting respectively an armband 7 to the belt 1. The straps 10 are disposed against the external wall of the belt 1 in order to limit the risks of rubbing between said straps and the body of the wearer.

Advantageously, the straps 10 are associated on an upper central zone of the belt 1 in order to limit the deformation stresses on said belts when they are associated with the armbands 7. In particular, the belt 1 comprises a top edge from which a panel 11 extends, which is disposed against the external wall of said belt, each strap extending on one side of said panel.

The panel 11 can be associated with the top edge of the belt 1, for example by stitching or welding. Each strap 10 can be fixed to the external wall of the belt 1 and/or to the panel 11, for example by adhesive bonding, welding or stitching, while being protected under said panel in particular relative to the risks of pulling away of said fixing.

In a variant, each strap 10 can be associated reversibly on the external wall of the belt 1 and/or under the panel 11 by known means such as press studs or self-gripping strips, said panel also being able to comprise means for reversible association with said external wall in order to be disposed between a closed configuration and an open position enabling the straps 10 to be withdrawn.

According to the embodiment depicted, the belt 1 comprises a housing 12 in which each strap 10 can be stored when said strap is not being used for connecting said belt to an armband 7.

In another embodiment in which each strap 10 is associated reversibly with the belt 1, at least one armband 7 is provided with a housing for storing the straps 10 when not in use. Advantageously, each armband 7 comprises a housing for storing a strap 10 connecting said armband to the belt 1.

Figure 2:
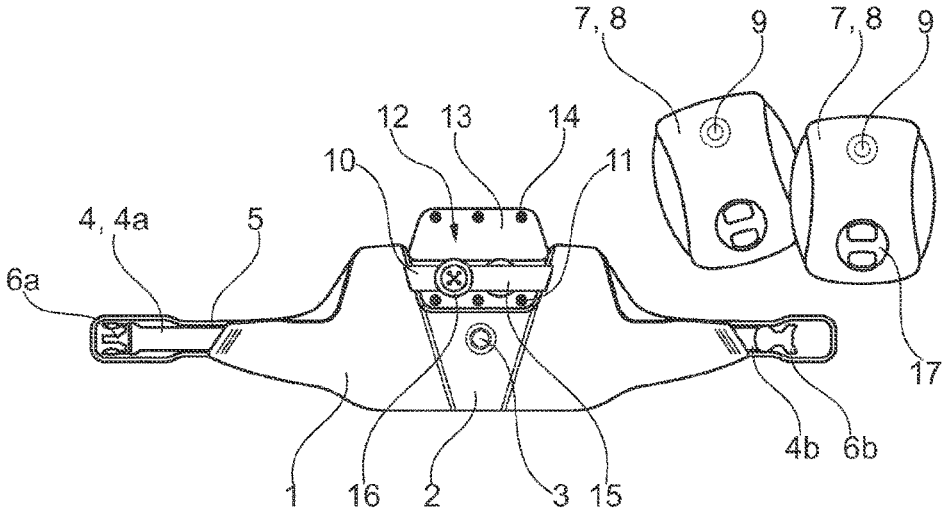
FIG. 2 is a representation of the buoyance-aid set of FIG. 1, showing the opening of a housing in the belt in which straps are stored.

In relation to FIG. 2, the housing 12 is formed between the panel 11 and a flap 13 that is disposed between a closed configuration against said panel enabling each strap 10 to be held in said housing and an open configuration making it possible to store said strap in said housing or to bring said strap out of said housing for use thereof.

In particular, the flap 13 has dimensions similar to those of the panel 11, said flap and said panel being associated together on the top edge of the belt 1. The flap 13 and the panel 11 are equipped with reversible association means formed at their bottom edges, such as press studs 14 or self-gripping strips, to enable each strap 10 to be held in the housing 12 when said flap is closed.

Figure 3:
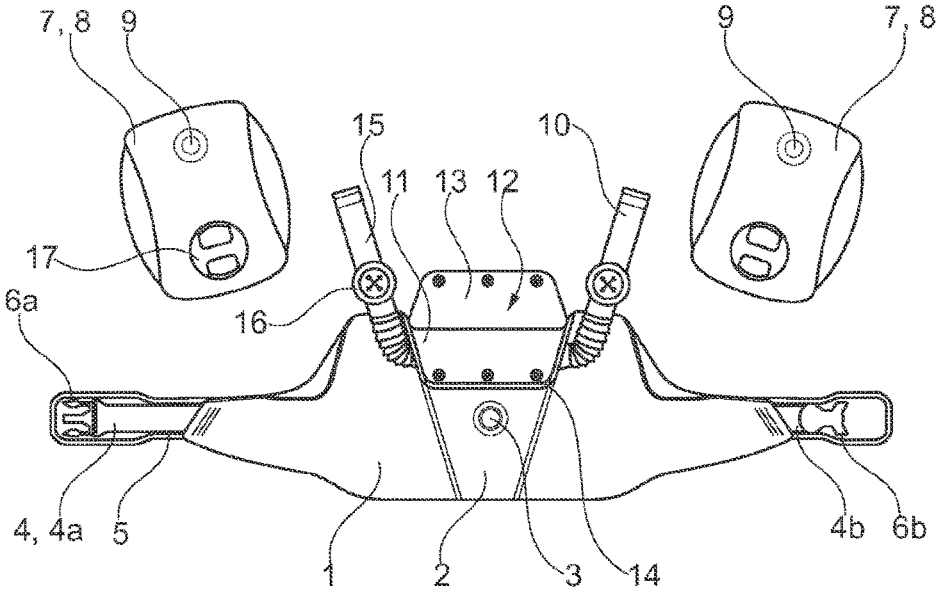
FIG. 3 is a representation of the buoyancy assistance kit according to FIG. 1, showing the deployment of the straps on either side of the open housing.

In relation to FIGS. 2 and 3, the straps 10 are disposed between a folded position of storage in the housing 12 and a deployed position for association therefore with respectively an armband 7. Each strap 10 is folded against the panel 11, for example transversely while being disposed one on the other, the flap 13 next being disposed in a closed configuration so as to conceal each strap 10.

The straps 10 each have a free part intended to be associated with an armband 7 for conjoint wearing of the belt 1 and armbands 7. To this end, the free part of each strap 10 is provided with a slot 15 under which a button 16 is fixed and each armband 7 is equipped with a loop 17 for passage of said free part, said free part being slidably inserted in said loop and folded until it can engage said slot on said button for holding said strap on said armband.

The passage loop 17 is formed on an external wall of the armband 7, said armband preferentially being worn with said loop oriented outwards in order to limit the risks of twisting of the strap 10 and positioned at the bottom part in order to limit the tension exerted on said strap. Furthermore, the button 16 of each strap 10 can be fixed to the external side of said strap so that, when the armband 7 is associated with said strap, said button is turned outwards to limit contact of said button with said armband.

Figure 4:
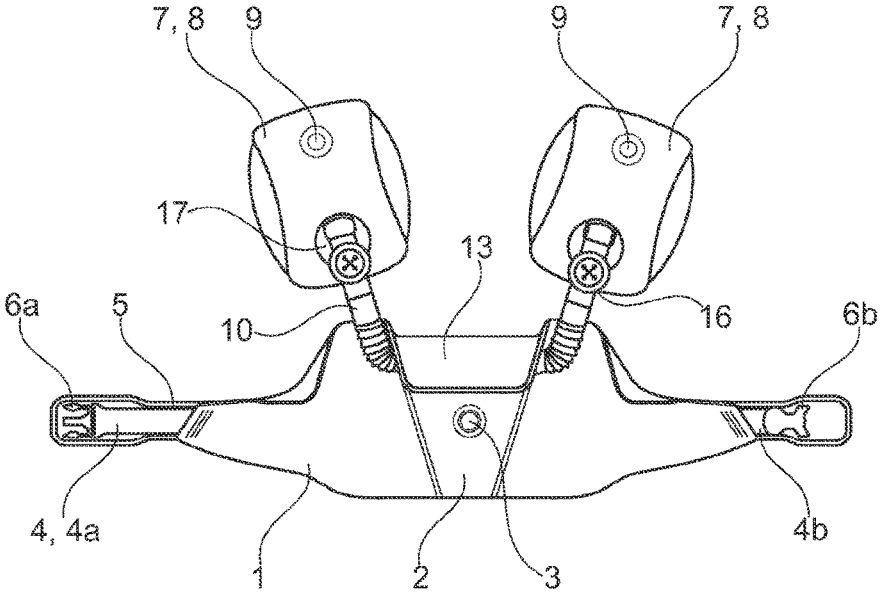
FIG. 4 is a representation of a buoyancy assistance kit according to FIG. 1, showing the armbands connected to the belt by means respectively of a strap, the housing being closed.

In relation to FIG. 4, the flap 13 is put back in the closed configuration after mounting of the straps 10 in the loops 17 of the armbands 7, for use of the buoyancy assistance kit.

To use the pair of armbands 7 independently of the belt 1, the slot 15 of each strap 10 is disengaged from its button 16 and said strap is removed from the loop 17, the flap 13 being put in the open configuration for storage of said strap.

In one embodiment, the armbands 7 are reversibly connected to the belt 1 by means of the same element 10, for example in the form of a strap, a link or a yoke made from elastic fabric, each free part of which carries the means for reversible association with an armband 7.

The element 10 may comprise a middle part fixed under the panel 11 or solely positioned between said panel and the external wall of the belt 1 to allow sliding of said element.

The invention claimed is:

1. A buoyancy assistance kit having a belt that, in use, surrounds part of a trunk of a wearer, and two armbands each of which, in use, surround a part respectively of an arm of said wearer, said belt and said armbands each comprising at least one element arranged to fulfil a buoyancy-aid function, each armband being connected to said belt by means of a connection element, each connection element having an elasticity enabling a relative position of the armband to be adjusted with respect to said belt during wearing, and each connection element comprises means for reversible association with one or more of the armband or the belt, the connection element fixed to only an external wall of the belt.

2. The buoyancy assistance kit according to claim 1, at least one from among the belt and the armbands is produced from a foam material the density of which is arranged so as to fulfil a buoyancy function.

3. The buoyancy assistance kit according to claim 1, at least one from among the belt and the armbands comprises an inflatable chamber.

4. The buoyancy assistance kit according to claim 1, the belt provided with a housing arranged so as to allow storage of each connection element in said housing when the armbands are disconnected from a respective one of said connection elements.

5. The buoyancy assistance kit according to claim 4, the housing comprising a flap disposed between an open configuration for storing each of the at least one connection elements in said housing and a closed configuration for holding each element in said housing.

6. The buoyancy assistance kit according to claim 1, each connection element being fixed to the belt.

7. The buoyancy assistance kit according to claim 1, at least one of the armbands provided with a housing arranged so as to enable at least one of the connection elements to be stored in said housing when said connection element is separated from the belt.

8. The buoyancy assistance kit according to claim 1, the armbands being connected to the belt by means of the same connection element.

9. The buoyancy assistance kit according to claim 1, the belt equipped with a harness for attaching the belt around the waist of the wearer, said harness being able to slide relative to said belt.

* * * * *